US007014300B2

(12) United States Patent
Hirota et al.

(10) Patent No.: US 7,014,300 B2
(45) Date of Patent: Mar. 21, 2006

(54) INKJET HEAD

(75) Inventors: Atsushi Hirota, Nagoya (JP); Chitoshi Ueki, Kokubu (JP)

(73) Assignees: Brother Kogyo Kabushiki Kaisha, Nagoya (JP); Kyocera Corporation, Kyoto (JP)

( * ) Notice: Subject to any disclaimer, the term of this patent is extended or adjusted under 35 U.S.C. 154(b) by 63 days.

(21) Appl. No.: 10/668,321

(22) Filed: Sep. 24, 2003

(65) Prior Publication Data

US 2004/0141033 A1 Jul. 22, 2004

(30) Foreign Application Priority Data

Sep. 24, 2002 (JP) ..... 2002-276445

(51) Int. Cl.
*B41J 2/045* (2006.01)

(52) U.S. Cl. ..... 347/72; 347/68

(58) Field of Classification Search ..... 347/38–72; 310/330, 322

See application file for complete search history.

(56) References Cited

U.S. PATENT DOCUMENTS 1,803,274 A * 4/1931 Sawyer ..... 310/330
5,233,256 A 8/1993 Hayashi et al.
5,266,964 A * 11/1993 Takahashi et al. ..... 347/72
5,402,159 A 3/1995 Takahashi et al.
6,416,172 B1 * 7/2002 Jeong et al. ..... 347/72
6,419,348 B1 7/2002 Kojima et al. ..... 347/72
6,431,691 B1 * 8/2002 Tanikawa et al. ..... 347/70
6,478,412 B1 * 11/2002 Hanabata ..... 347/71
2002/0024567 A1 2/2002 Takagi

FOREIGN PATENT DOCUMENTS

JP 11179898 7/1999
JP 2001-162796 A 6/2001
JP 2000127384 7/2002

* cited by examiner

*Primary Examiner*—Manish Shah
*Assistant Examiner*—Geoffrey S. Mruk
(74) *Attorney, Agent, or Firm*—Oliff & Berridge, PLC

(57) ABSTRACT

An inkjet head includes a cavity unit and a piezoelectric unit stacked on the cavity unit. The cavity unit has a plurality of ink pressure chambers and a plurality of nozzles being in fluid communication with respective ones of the ink pressure chambers. The piezoelectric unit includes a laminate of four piezoelectric layers and two common electrodes. The piezoelectric unit is provided with a plurality of driving electrodes formed on a top face thereof at positions corresponding to respective ones of the pressure chambers. One of the common electrodes is provided between the upper most piezoelectric layer and the piezoelectric layer immediately therebelow so as to extend substantially over the whole area defined between those two piezoelectric layers. The other common electrode is located between the lower most piezoelectric layer and the piezoelectric layer immediately thereabove so as to extend substantially over the whole area defined therebetween.

21 Claims, 6 Drawing Sheets

INKJET HEAD

BACKGROUND OF THE INVENTION

1. Field of Invention

The present invention relates to an inkjet head, and more particularly to an inkjet head that is provided with a piezoelectric actuator for ejecting ink.

2. Description of Related Art

An example of such kind of inkjet head is disclosed in U.S. Pat. No. 6,419,348, the disclosure of which is hereby incorporated by reference. The inkjet head disclosed in the above-mentioned U.S. patent has a cavity plate formed with a plurality of ink chambers and a laminated piezoelectric actuator. The piezoelectric actuator is bonded to the cavity plate so as to cover the openings of the ink chambers. The piezoelectric actuator is formed of multiple piezoelectric ceramic layers each made of lead zirconate titanate (PZT). On each layer of the piezoelectric ceramics, internal electrodes are discretely created. Further, a common electrode is provided so as to cover the top face of the piezoelectric actuator.

When driving signals are supplied to the internal electrodes, the piezoelectric ceramic layers distort in correspondence with the driving signals to cause pressure changes within the ink chambers. Based on these pressure changes, ink is ejected from nozzles of the inkjet head that are in fluid communication with the ink chambers.

Generally, the piezoelectric actuator for the inkjet head is produced by first laminating multiple green sheets of the piezoelectric layers with the internal electrodes interposed therebetween, providing the common electrode on the top of the obtained laminate of green sheets, and then sintering the same. The piezoelectric actuator, however, may become warped or deformed in a wavy form during the sintering process since the contraction percentage differs between the green sheets of the piezoelectric layers and the metals forming the electrodes. Such warp or deformation of the piezoelectric actuator may form a gap between the cavity plate and the piezoelectric actuator attached thereon, and such a gap may, in turn, cause leak of ink from the ink chambers.

Thus, there is a need for an inkjet head provided with a piezoelectric actuator that does not become warped or deformed during the sintering process thereof.

SUMMARY OF THE INVENTION

The present invention is advantageous in that an inkjet head is provided that satisfies the above mentioned need.

An inkjet head according to an aspect of the invention includes, a cavity unit having a plurality of ink pressure chambers formed at a regular interval, and a piezoelectric unit stacked on the cavity unit. The piezoelectric unit includes a laminate of a plurality of piezoelectric layers and a plurality of common electrodes. The piezoelectric sheet is provided with a plurality of driving electrodes formed on a top face thereof at positions corresponding to respective ones of the pressure chambers. The piezoelectric layers and the common electrodes are arranged such that upper and lower halves of the piezoelectric unit in a lamination direction thereof are mirror symmetric to each other.

In the piezoelectric sheet arranged as above, the forces that are generated due to the difference of the contraction percentage between the piezoelectric layers and the common electrodes cancel each other. Accordingly, the piezoelectric unit does not become warped or deformed into a wavy form during the sintering process thereof, and hence the piezoelectric unit stacked on the cavity unit of the inkjet head can close the openings of the ink pressure chambers in leakproof condition.

In particular cases, the laminate includes a plurality of subunits, each of which includes a pair of the piezoelectric layers and one common electrode interposed therebetween.

In other cases, the piezoelectric unit includes even numbers of the piezoelectric layers and odd numbers of the common electrodes, and the piezoelectric layers and the common electrodes are laminated alternately with each other.

In still other cases, the piezoelectric unit includes a pair of the common electrodes interposed between the piezoelectric layers such that distances from a center of the piezoelectric unit to respective ones of the pair of common electrodes in the lamination direction are substantially the same.

Optionally, each of the common electrodes may extend substantially over the whole area defined between the piezoelectric layers sandwiching said common electrode. The common electrodes configured as above increase the toughness of the piezoelectric unit over the whole area thereof, and thereby effectively prevent the piezoelectric unit from suffering damage or cracking.

Optionally, each of the common electrodes may have an exposed portion that is exposed on a side surface of the piezoelectric unit. Such an exposed portion allows the common electrode to be grounded there through. A conductive pattern may be formed on the side surface of the piezoelectric unit, which is electrically connected with each of the common electrodes at the exposed portion.

The piezoelectric unit may be further provided with a surface electrode formed on a peripheral area of the top face thereof. The conductive pattern may extend up to the surface electrode to be electrically connected therewith.

In some particular cases, the piezoelectric unit has a substantially trapezoidal form, and the exposed portion of each of the common electrodes is exposed on an oblique side of the piezoelectric unit.

According to another aspect of the invention, a piezoelectric actuator for an inkjet head is provided that includes a multilayer sheet including a plurality of piezoelectric layers and a plurality of common electrodes, and a plurality of driving electrodes formed on an outer surface of the multilayer sheet. The piezoelectric layers and the common electrodes are arranged such that upper and lower halves of the multilayer sheet in a lamination direction thereof are substantially mirror symmetric to each other.

BRIEF DESCRIPTION OF THE DRAWINGS

The invention will be described with reference to the drawings in which.

DETAILED DESCRIPTION OF PREFERRED EMBODIMENTS

Hereinafter, an inkjet head 1 according to an embodiment of the present invention will be described with reference to the accompanying drawings.

Figure 1:
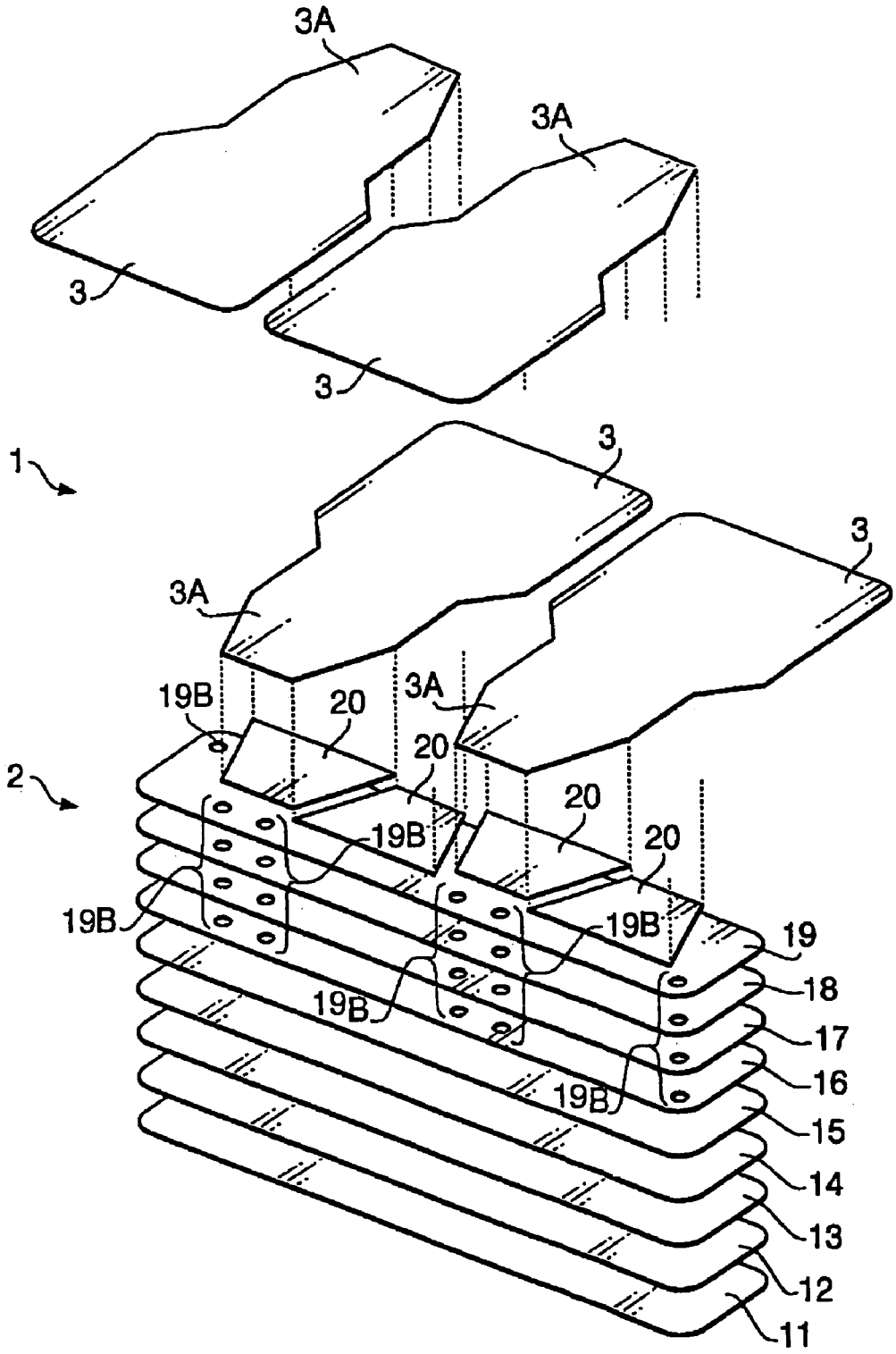
FIG. 1 is an exploded perspective view of the inkjet head according to an embodiment of the invention.

FIG. 1 is an exploded perspective view of the inkjet head 1 according to the present embodiment. The inkjet head 1 includes a body 2, four plate type trapezoidal piezoelectric sheets 20, and four flexible printed boards (FPC boards) 3.

The body 2 is a laminate of a plurality of substantially rectangular thin metal plates. The piezoelectric sheets 20 are attached on the top face of the body 2 in two rows in a staggered configuration.

Each of the FPC boards 3 has an extended portion 3A having a substantially trapezoidal shape similar to that of the piezoelectric sheets 20 and on which a plurality of electrode patterns are formed as will be described later. Each FPC board 3 is electrically connected with the corresponding piezoelectric sheet 20 by attaching the extended portion 3A thereon.

Each of the substantially trapezoidal piezoelectric sheets 20 has a short upper side, a long lower side parallel to the upper side, and two oblique sides. The piezoelectric sheets 20 are arranged on the body 2 such that the upper and lower sides thereof are substantially parallel to the longitudinal direction of the body 2 and such that the oblique sides of adjacent piezoelectric sheets overlap each other in a width direction of the body 2.

Figure 2:
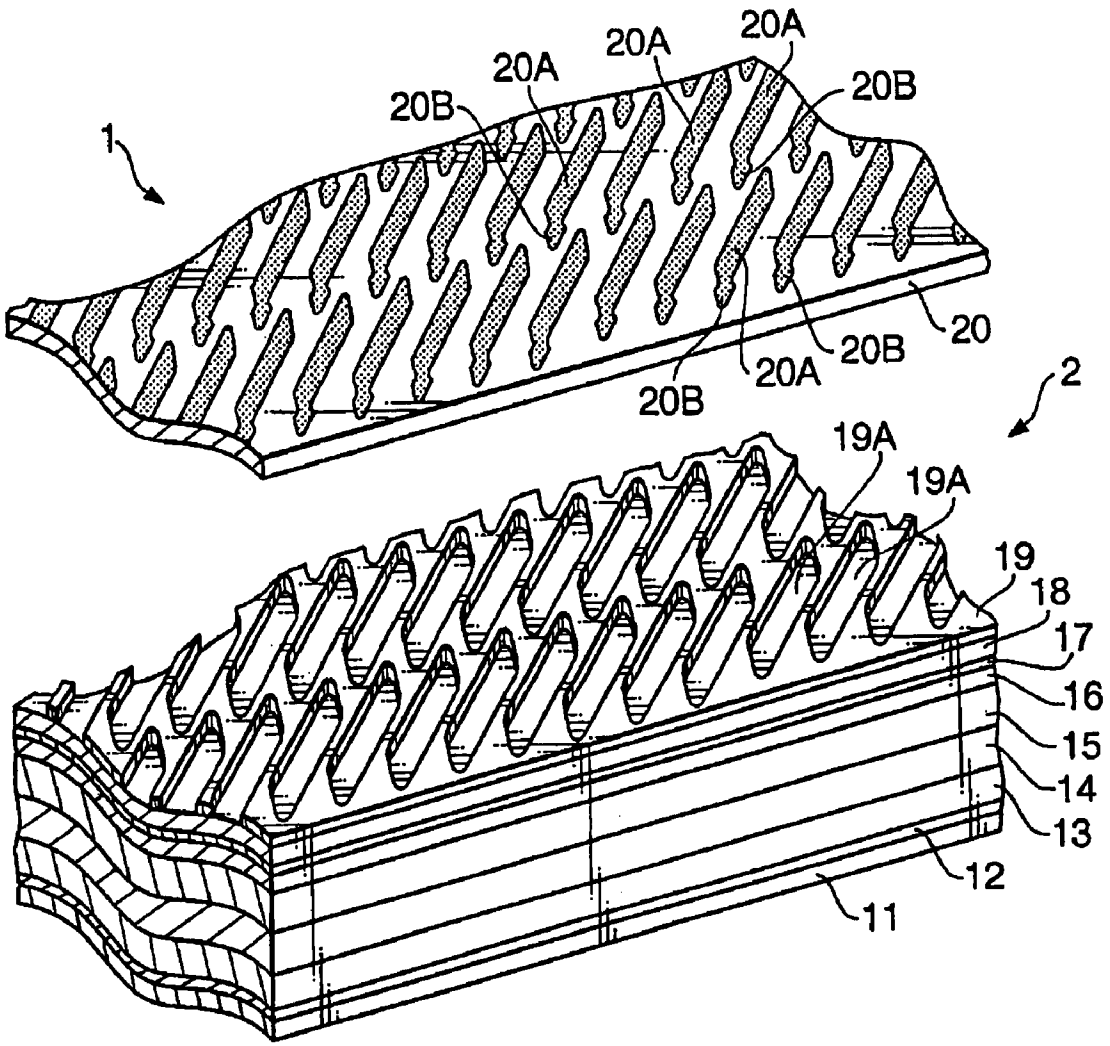
FIG. 2 shows a perspective view of a part of a body and a part of the piezoelectric sheet of the inkjet head shown in FIG. 1.
Figure 3:
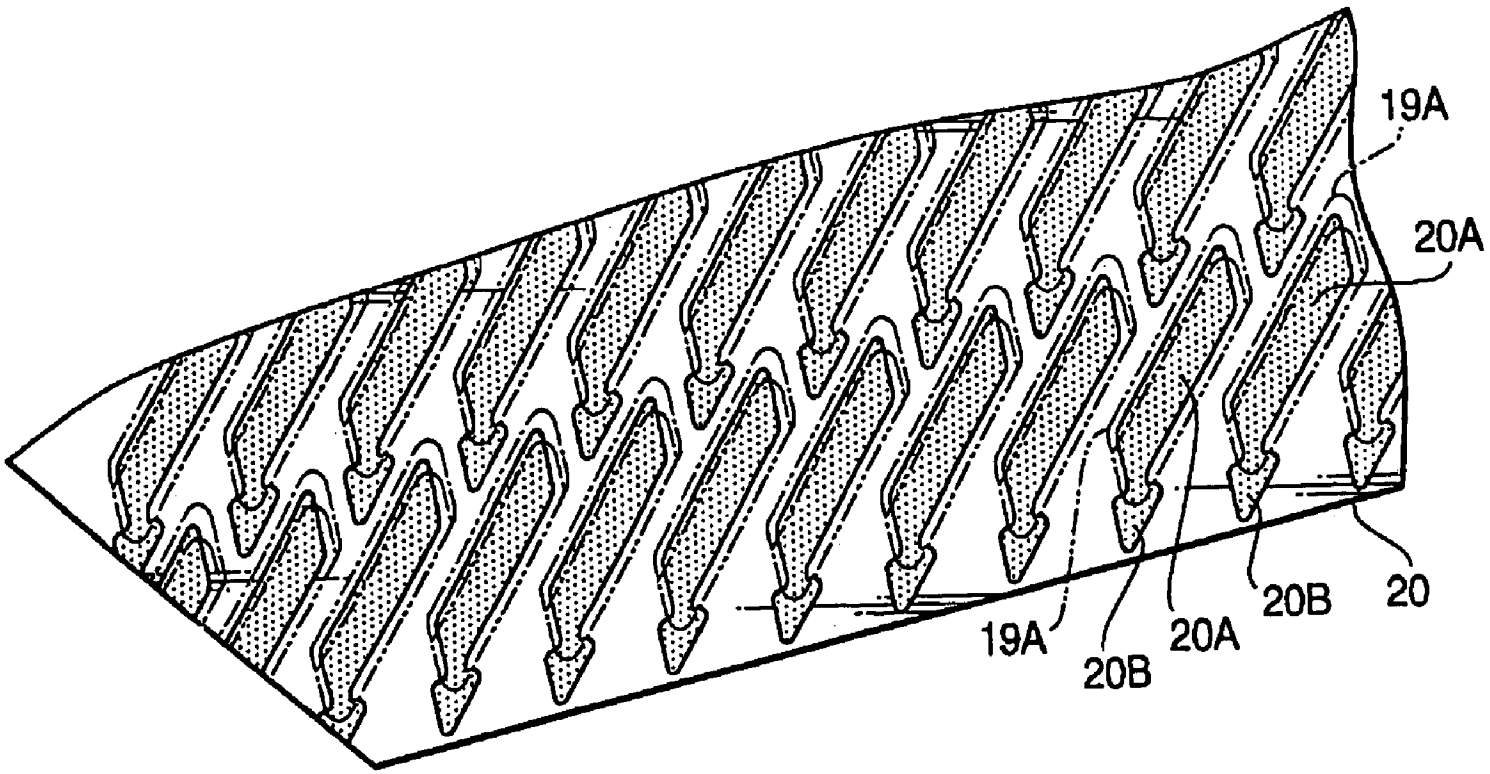
FIG. 3 shows a top view of the part of the piezoelectric sheet shown in FIG. 2.

FIG. 2 shows a perspective view of a part of the body 2 along with a part of the piezoelectric sheet 20 to be attached thereon. Further, FIG. 3 shows a top view of the part of the piezoelectric sheet 20 shown in FIG. 2. The body 2 is provided with a plurality of ink pressure chambers 19A formed on the face on which the piezoelectric sheets 20 are laminated. The ink pressure chambers 19A are arranged in matrix, or in a plurality of rows, at a density corresponding to the printing resolution required for the inkjet head 1. Each ink pressure chamber 19A is formed into a substantially rhombus shape having a pair of acute angle corners. The ink pressure chambers 19A are arranged such that the acute angle corners of each ink pressure chamber 19A of one row is interposed between other ink pressure chambers belonging to the next rows. In this way, the ink pressure chambers 19*a* can be arranged at a high density.

Each piezoelectric sheet 20 is provided with a plurality of driving electrodes 20A formed on the top face thereof at positions corresponding to respective ones of the ink pressure chambers 19A.

Figure 4:
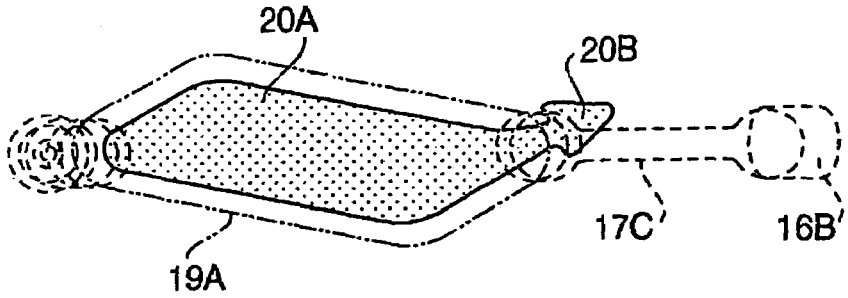
FIG. 4 shows a top view of a driving electrode formed on the piezoelectric sheet shown in FIG. 3.

FIG. 4 shows a top view of one of the driving electrodes 20A. The driving electrode has a substantially rhombus shape that is similar to but slightly smaller than the projected shape of the ink pressure chamber 19A (the shape of the ink pressure chamber 19A observed from above). A land pattern 20B, having an arrow like shape, extends from an acute angle corner of the driving electrode 20A. While the driving electrode 20A is formed within an area that is defined right above the corresponding ink pressure chamber 19A, the land pattern 20B is formed outside that area. It should be noted that the land pattern 20B extends from the acute angle corner of the driving electrode 20A that corresponds to (placed generally above) the acute angle corner of the ink pressure chamber 19A through which ink is supplied into that ink pressure chamber 19A.

Figure 5:
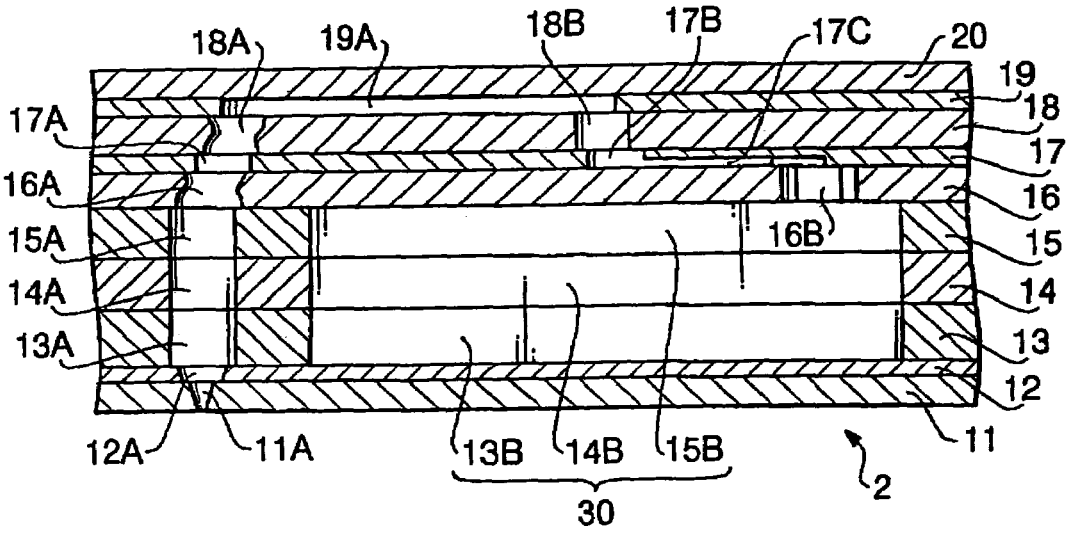
FIG. 5 shows a sectional view of a part of the inkjet head shown in FIG. 1.

FIG. 5 shows a sectional view of a part of the inkjet head 1. The body 2 of the inkjet head 1 has a nine layer structure obtained by laminating nine metal sheets each having a substantially rectangular shape. The nine metal sheets are, from the bottom of the body 2 shown in FIG. 5, a nozzle plate 11, a cover plate 12, first, second and third manifold plates 13, 14 and 15, a supply plate 16, an aperture plate 17, a spacer plate 18, and a base plate 19.

Referring back to FIG. 1, the body 2 is provided with a plurality of pairs of ink supply channels 19B formed in front of the upper side of each piezoelectric sheet 20 (note that two pairs of them are not shown in FIG. 1). Each ink supply channel 19B consists of openings formed in the supply plate 16, the aperture plate 17, the spacer plate 18 and the base plate 19, respectively. The body 2 is further provided with an additional two ink supply channels 19B formed near respective ends thereof in the longitudinal direction, and more specifically, near one end of the lower side of the most left and most right piezoelectric sheets, respectively.

Referring to FIG. 5, the ink supply channels 19B allow ink from and external ink tank to be introduced into ink manifold channels 30, which will be described later. Referring to FIG. 1, it should be noted that a filter (not shown) having a plurality of fine through holes is provided for each ink supply channel 19B at the lower side of the base plate 19 (at the side of the base plate 19 facing the spacer plate 18) so as to prevent entry of foreign matter into the ink.

Referring back to FIG. 5, the nozzle plate 11 is formed with a plurality of fine diameter nozzles 11A through which ink is to be ejected.

The cover plate 12 is provided with a plurality of through holes 12A formed at positions corresponding to respective ones of the nozzles 11A. Each through hole 12A is in fluid communication with the corresponding nozzle 11A and serves as an ink channel. Further, the cover plate 12 defines the under surfaces of the ink manifold channels 30 formed by the first, second and third manifold plates 13, 14 and 15 as will be described later.

The first manifold plate 13 is provided with a plurality of through holes 13A formed at positions corresponding to respective ones of the through holes 12A of the cover plate 12 so as to be in fluid communication therewith and serve as ink channels. The first manifold plate 13 is also provided with a plurality of elongated openings 13B extending in the longitudinal direction of the first manifold plate 13, or in the direction of the rows of the ink pressure chambers 19A. Note that the elongated openings 13B constitute a part of each ink manifold channel 30.

The second manifold plate 14 is provided with a plurality of through holes 14A formed at positions corresponding to respective ones of the through holes 13A of the first manifold plate 13 so as to be in fluid communication therewith and serve as ink channels. The second manifold plate 14 is also provided with a plurality of elongated openings 14B extending in the longitudinal direction of the second manifold plate 14, or in the direction of the rows of the ink pressure chambers 19A. Note that the elongated openings 14B constitute a part of each ink manifold channel 30.

The third manifold plate 15 is provided with a plurality of through holes 15A formed at positions corresponding to respective ones of the through holes 14A of the second manifold plate 14 so as to be in fluid communication therewith and serve as ink channels. The third manifold plate 15 is also provided with a plurality of elongated openings 15B extending in the longitudinal direction of the third manifold plate 15, or in the direction of the rows of the ink pressure chambers 19A. Note that the elongated openings 15B constitute a part of each ink manifold channel 30.

The supply plate 16 is provided with a plurality of through holes 16A formed at positions corresponding to respective ones of the through holes 15A of the third manifold plate 15 so as to be in fluid communication therewith and serve as ink channels. The supply plate 16 is further provided with a plurality of through holes 16B. Each through hole 16B is in fluid communication with one of the ink manifold channels 30 so as to serve as an ink channel. As shown in FIG. 5, the through holes 16B are formed in a vicinity of a side edge of the corresponding elongated opening 15B (the side edge at the right hand side in FIG. 5). Further, as shown in FIG. 4, each through hole 16B is formed on an extension of the diagonal of the corresponding ink pressure chamber 19A at a position near the acute angle corner of the ink pressure chamber 19A on the side thereof opposite from the through hole 16A (See FIG. 5).

As shown in FIG. 5, each ink manifold channel 30 is defined by the upper surface of the cover plate 12, elongated openings 13B, 14B and 15B, and the under surface of the supply plate 16. Each ink manifold channel 30 is long in the longitudinal direction of the body 2 and serves as a common ink chamber for supplying ink into the ink pressure chambers 19A.

The aperture plate 17 is provided with a plurality of fine diameter through holes 17A being in fluid communication with respective ones of the through holes 16A of the supply plate 16 so as to serve as ink channels. The aperture plate 17 is further provided with a plurality of through holes 17B, each formed below the acute angle corner of the ink pressure chamber 19A at the ink supply side thereof. A plurality of elongated grooves 17C are formed on the side of the aperture plate facing the supply plate 16 in a vicinity of respective ones of the through holes 17B. Each groove 17C extends from the lower end of the corresponding through hole 17B up to a position facing the corresponding through hole 16B of the supply plate 16. The grooves 17C are formed so as to have a depth that is substantially one half of the thickness of the aperture plate 17.

The spacer plate 18 is provided with a plurality of through holes 18A, which are in fluid communication with respective ones of the through holes 17A, and a plurality of through holes 18B, which are in fluid communication with respective ones of the through holes 17B.

The base plate 19 is provided with a plurality of substantially rhombus openings which serve as the ink pressure chambers 19A. The ink pressure chambers 19A are arranged such that each is in fluid communication at respective acute angle corners thereof with the corresponding through holes 18A and 18B of the spacer plate 18. Note that the upper sides of the ink pressure chambers 19*a* are closed by the piezoelectric sheets 20 stacked on the base plate 19.

Next, the structure of the piezoelectric sheet 20 and the structure for electrically connecting the piezoelectric sheet 20 and the FPC board 3 extending from a power supply circuit (not shown) will be described.

Figure 6:
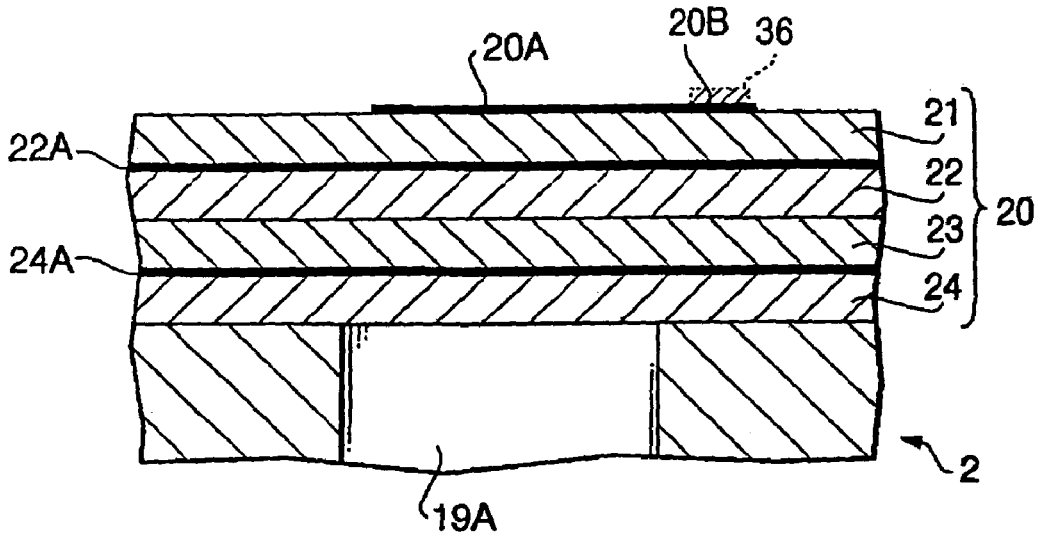
FIG. 6 shows another sectional view of a part of the inkjet head shown in FIG. 1.
Figure 7:
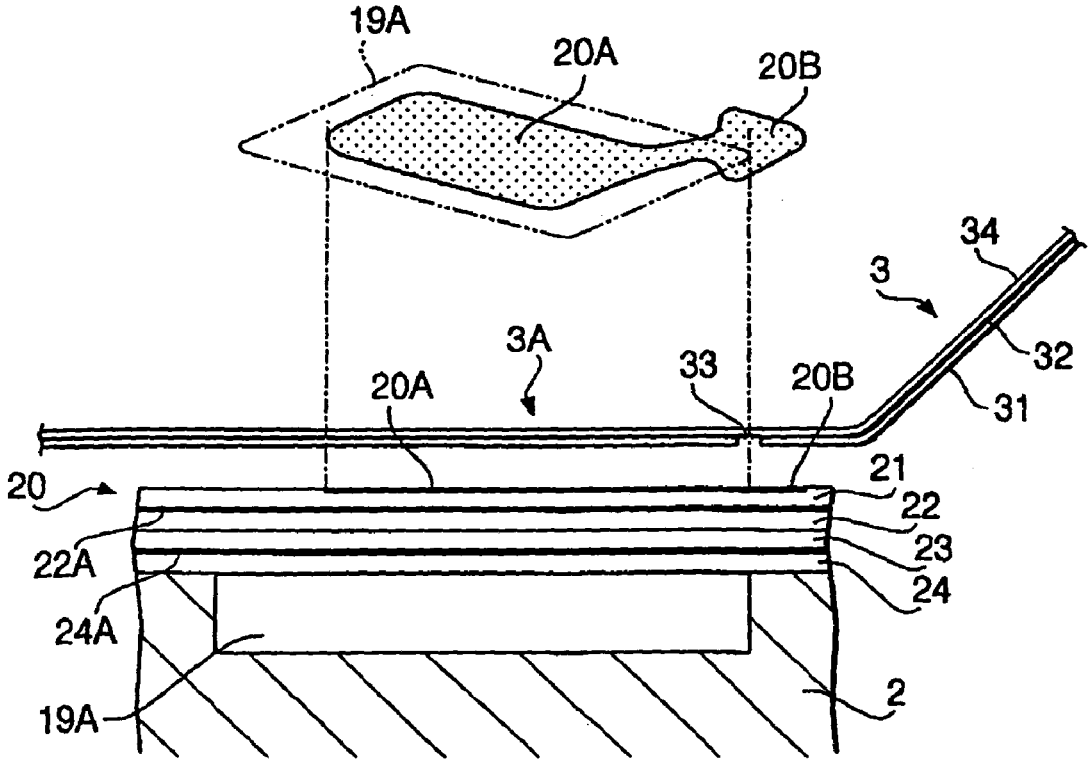
FIG. 7 schematically illustrates positional relationship between an ink pressure chamber, the driving electrode, and a flexible printed board of the inkjet head shown in FIG. 1.

FIG. 6 shows a sectional view of a part of the inkjet head 1, and FIG. 7 schematically illustrates the positional relationship between the ink pressure chamber 19A, driving electrode 20A, and the FPC board 3.

Each piezoelectric sheet 20 is a laminate including four piezoelectric layers, i.e., first, second, third, and fourth piezoelectric layers 21, 22, 23 and 24.

The driving electrodes 20A and the land patterns 20B are formed on the top face of the first piezoelectric layer 21. As previously described, the driving electrodes 20A are formed at positions corresponding to the ink pressure chambers 19A. Each driving electrode 20A has a substantially rhombus shape that is similar to but slightly smaller than the projected shape of the corresponding ink pressure chamber 19A. The land pattern 20B having an arrow like shape extends from one acute angle corner of the corresponding driving electrode 20A up to a position that is outside the area defined right above the corresponding ink pressure chamber 19A.

A common electrode 22A is formed on the top surface of the second piezoelectric layer 22 over substantially the whole area thereof. The common electrode 22A serves as a common counter electrode of the plurality of driving electrodes 20A. No electrodes are formed on the top face of the third piezoelectric layer 23. An additional common electrode 24A is formed on the top surface of the fourth piezoelectric layer 24 over substantially the whole area thereof.

Figure 8:
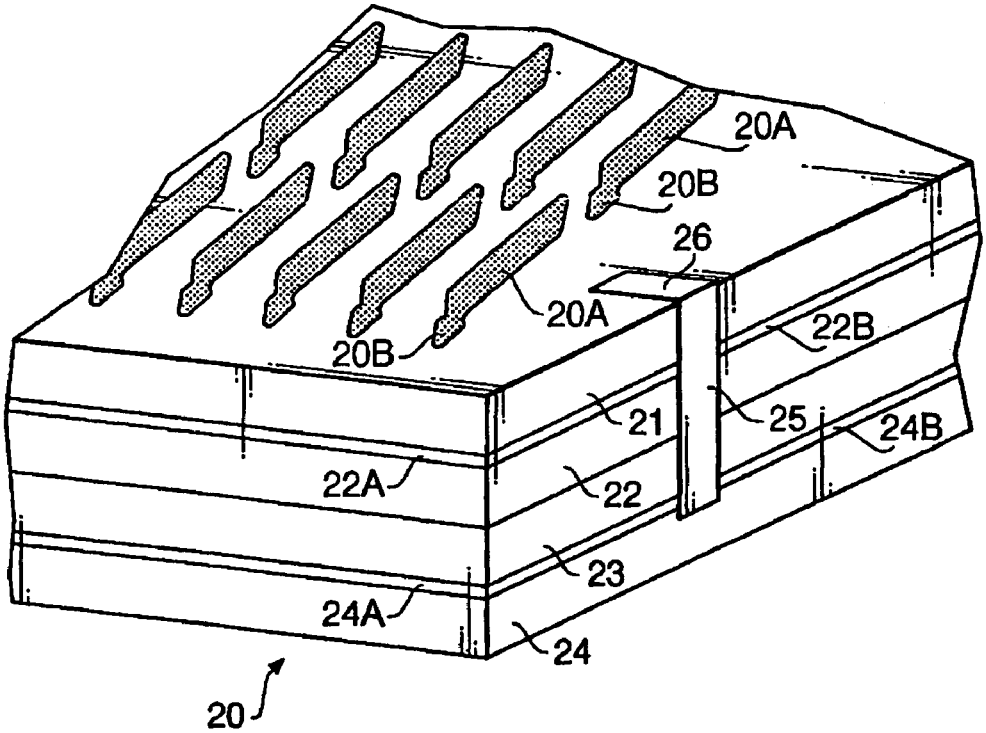
FIG. 8 shows a perspective view of a part of the piezoelectric sheet.

FIG. 8 shows a perspective view of a part of the piezoelectric sheet 20.

The common electrode 22A is formed such that the side ends 22B thereof are exposed on both sides of the second piezoelectric layers 22 (on the oblique sides of the piezoelectric sheet 20, see FIG. 1). Similarly, the common electrode 24A is formed such that the side ends 24B thereof are exposed on both sides of the fourth piezoelectric layer 24 (on the oblique sides of the piezoelectric sheet 20).

The common electrode 22A of the second piezoelectric layer 22 and the common electrode 24A of the fourth piezoelectric layer 24 are electrically connected to each other at the side ends 22B, 24B of the piezoelectric layers (at the oblique sides of the piezoelectric sheet 20) by an additional conductive pattern 25 formed on the oblique sides of the piezoelectric sheet 20, for example. The common electrodes 22A and 24A are further electrically connected to a surface electrode 26 formed on the top face of the piezoelectric sheet 20 via the conductive pattern 25, for example. The surface electrode 26 is formed on a peripheral area of the top face of the piezoelectric sheet 20 so as not to confront the pressure ink chambers 19A (or so as to be outside the areas defined right above the pressure ink chambers 19A).

Referring to FIG. 7, each FPC board 3 extending from the not shown power supply circuit is connected to the top face of the corresponding piezoelectric sheet 20. As shown in FIG. 7 the FPC board 3 includes a base film 31 such as polyimide film. The base film 31 is provided with a plurality of conductive patterns 32 adhered to the top face thereof. The conductive patterns 32 are made of copper foils and extend up to positions corresponding to respective ones of the land patterns 20B formed on the piezoelectric sheet 20. The top surface of the base film 31 and the conductive patterns 32 adhered thereto are covered with a resist layer 34 which serves as an insulative layer. The base film 31 is provided with a plurality of through holes 33 formed at positions corresponding to respective ends of the conductive patterns 32. Each through hole 33 is formed slightly smaller than the land pattern 20B formed on the piezoelectric sheet 20.

As shown in FIG. 6, preparative solder 36 is provided on each land pattern 20B of the piezoelectric sheet 20, which assists in connecting the land pattern 20*b* to the conductive pattern 32 of the FPC board 3. That is, the land patterns 20B and the conductive patterns 32 can be electrically connected to each other through the through holes 33 by placing the extended portion 3A of FPC board 3 on the piezoelectric sheet 20 so that the through holes 33 are located on respective land patterns 20B, and then heating the preparative solder by means of thermo compression, for example.

It should be noted that the surface electrode 26 formed on the piezoelectric sheet 20 and being electrically connected to the common electrodes 22A and 24A is similarly connected electrically to one of the conductive patterns 32 of the FPC board 3 through the through hole 33.

In the piezoelectric sheet 20, active portions are defined in the first piezoelectric layer 21 between the driving electrodes 20A and the common electrode 22B formed on the second piezoelectric layer 22. Thus, when driving voltage is applied between the common electrodes (22A, 24A) and one of the driving electrodes 20A, the piezoelectric sheet 20 deforms and thereby apply pressure to ink in the ink pressure chamber 19A corresponding to the driving electrode 20A.

It should be noted that the piezoelectric sheet 20 may be warped or deformed into a wavy form during the sintering process of the first through fourth piezoelectric layers (21, 22, 23, 24) due to the difference in the contraction percentage between the ceramics forming the piezoelectric layers and the metallic material forming the electrodes. The common electrode 24A formed on the top face of the forth piezoelectric layer 24 prevents the piezoelectric sheet 20 from being warped or deformed as above. Thus, the piezoelectric sheet 20 can be produced with high flatness.

In addition to the above, the second, third and fourth piezoelectric layers 22, 23 and 24 serve as restriction layers that allow the active portions of the first piezoelectric layer 21 to deform only toward the ink pressure chambers 19A.

Further, since the common electrodes 22A and 24A are formed over the whole area of the piezoelectric layers 22 and 24, respectively, the toughness of piezoelectric sheet 20 is uniform and does not vary locally. The toughness of the laminated and sintered piezoelectric sheet 20 is the sum of the toughness of the metallic material forming the common electrodes 22A and 24A and the toughness of the piezoelectric ceramics forming each of piezoelectric layers 21 through 24 (which is lead zirconate titanate, for example). Thus, the toughness of the piezoelectric sheet 20 is larger than that of the piezoelectric ceramics alone.

Next, the operation of the inkjet head 1 configured as above will be described with reference to FIG. 5.

The ink supplied into the ink manifold channel 30 through the ink supply channels 19B (see FIG. 1) flows into the ink pressure chamber 19A through the through hole 16B, the groove 17C, the through hole 17B, and the through hole 18B. When the driving voltage is applied between the driving electrode 20A and the common electrodes (22A, 24A), the piezoelectric sheet 20 deforms toward the ink pressure chamber 19A. As a result, the ink is pressed out from the ink pressure chamber 19A, flows through the through holes 18A through 12A to be ejected from the nozzle 11A.

As described above, in the inkjet head 1 according to the present embodiment, the body 2 of the inkjet head 1 has a laminated structure including nine thin metal plates 11 through 19. The base plate 19, which is one of the plates constituting the body 2, is formed with a plurality of substantially rhombus ink pressure chambers 19A arranged in matrix. The upper sides of the ink pressure chambers 19A are closed with the piezoelectric sheets 20 stacked on the top face of the body 2.

As shown in FIG. 6 and FIG. 7, each piezoelectric sheet 20 is obtained by laminating four piezoelectric layers (i.e., first, second, third and fourth piezoelectric layers 21, 22, 23 and 24), with the common electrode 22A being formed between the first and second piezoelectric layers 21 and 22 over the whole area defined therebetween, and also the common electrode 24A being formed between the third and fourth piezoelectric layers 23 and 24 over the whole area defined therebetween, and then sintering the obtained laminate. In other words, the piezoelectric sheet 20 formed as a laminate of a plurality of piezoelectric sheet subunits, each of which include a pair of the piezoelectric layers (21 and 22, or, 23 and 24) and one of the common electrodes (22A, 24A) interposed therebetween.

Further, the first piezoelectric layer 21 is provided with a plurality of driving electrodes 20A formed on the top face thereof at positions corresponding to the ink pressure chambers 19A. Each driving electrode 20A has a substantially rhombus shape similar to that of each ink pressure chamber 19A. Each land pattern 20B has an arrow like shape and extends from one acute angle corner of the corresponding driving electrodes 20A up to a position that is outside the area defined right above the corresponding ink pressure chamber.

As shown in FIG. 7, the extended portion 3A of the FPC board 3 includes the base film 31, the conductive patterns 32 provided on the base film 31, and the resist layer 34 covering the top face of the base film 31 and the conductive patterns 32. The base film is provided with a plurality of through holes 33 formed at each end of the conductive patterns 32.

The extended portion 3A of the FPC board 3 is placed on the piezoelectric sheet 20 so that each of through holes 33 faces the corresponding land pattern 20B, on which the preparative solder 36 is provided. Then, the FPC board 3 is soldered to the piezoelectric sheet 20 by means of thermo compressing.

It should be noted that the piezoelectric layers 21 through 24 and the common electrodes 22A and 24A, which configure the piezoelectric sheet 20, are laminated such that the upper and lower halves of piezoelectric sheet 20 in the lamination direction thereof are mirror symmetric to each other. In other words, the two common electrodes 22A and 24A are interposed between the piezoelectric layers (21–24) such that distances from a center of the piezoelectric sheet to respective common electrodes (22A, 24A) in the lamination direction of the piezoelectric sheet 20 are substantially the same. Accordingly, the bending of the piezoelectric sheet 20, which is generated during the sintering process thereof due to contraction percentage difference between the piezoelectric sheets 21 through 24 and the common electrodes 22A and 24A, can be reduced and the piezoelectric sheet 20 can be produced with high dimensional accuracy.

Further, since the common electrodes 22A and 24A are formed so as to cover substantially the whole area of the second and fourth piezoelectric layers 22 and 24, respectively, the toughness of the piezoelectric sheet 20 is increased, which in turn prevents damage to or cracking of the piezoelectric sheet 20 during handling.

Further, since the common electrodes 22A and 24A are connected to each other and grounded at the side of the piezoelectric sheet 20, unstable functioning of the common electrodes 22A and 24A due to bearing of electrical charges can be prevented.

While the invention has been described in detail with reference to specific embodiments thereof, it would be apparent to those skilled in the art that various changes and modifications may be made therein without departing from the spirit of the invention, the scope of which is defined by the attached claims.

Figure 9:
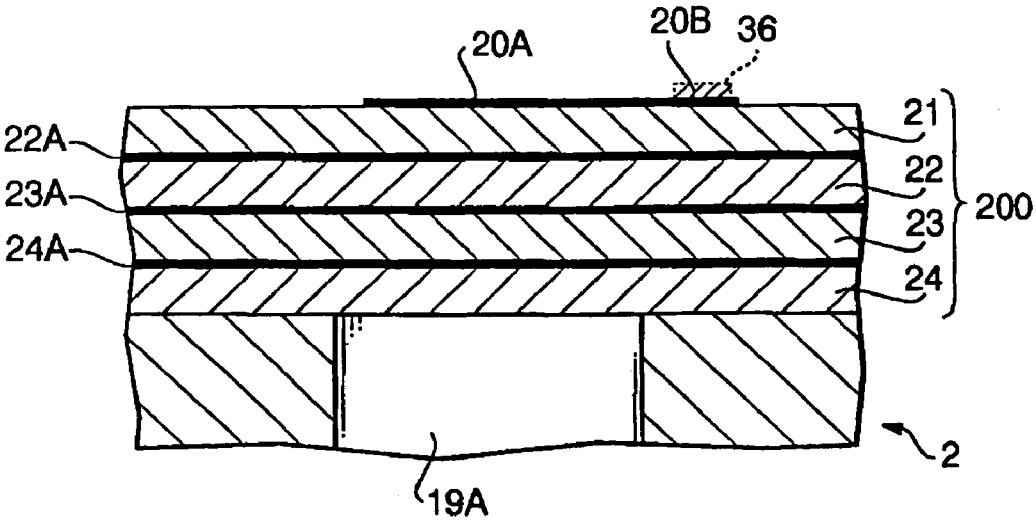
FIG. 9 shows a sectional view of a part of a modified piezoelectric sheet.

FIG. 9 shows a sectional view of a part of an piezoelectric sheet 200 which is an example of a modification of the piezoelectric sheet 20. Note that elements in FIG. 9 that are substantially the same as those described in the previous figures are denoted by the same reference numbers.

In the modified piezoelectric sheet 200, a common electrode 23A is provided between the second and third piezoelectric layers 22 and 23 so as to extend over substantially the whole area defined therebetween. In other words, another common electrode 23A is provided at the center of piezoelectric sheet 20 in the lamination direction thereof in addition to the common electrode 22A, which is provided between the upper most piezoelectric layer (first piezoelectric layer) 21 and the second piezoelectric layer 22, and the common electrode 24A, which is provided between lower most piezoelectric layers (fourth piezoelectric layer) 24 and third piezoelectric layer 23 immediately above the fourth piezoelectric layer 24.

The toughness of the piezoelectric sheet configured as above is the sum of the toughness of the piezoelectric ceramics of the piezoelectric layers 21 through 24 and the toughness of the metallic material of the common electrodes 22A, 23A and 24A. The toughness of the piezoelectric sheet is much larger than that of the piezoelectric ceramics alone, and therefore damage to and cracking of the piezoelectric sheet 200 during handling can be reliably prevented.

The present disclosure relates to the subject matter contained in Japanese Patent Application No. 2002-276445, filed on Sep. 24, 2002, which is expressly incorporated herein by reference in its entirety.

What is claimed is:

1. An inkjet head, comprising:

a cavity unit having a plurality of ink pressure chambers formed at a regular interval; and a piezoelectric unit stacked on said cavity unit to close openings of said ink pressure chambers, said piezoelectric unit including a laminate and a plurality of driving electrodes, the laminate including a plurality of piezoelectric layers and a plurality of common electrodes, each common electrode extending substantially over the whole area defined between adjacent piezoelectric layers sandwiching said common electrode, said plurality of piezoelectric layers and said plurality of common electrodes being arranged such that an upper half of said laminate and a lower half of said laminate are substantially mirror symmetric in a lamination direction, and said plurality of driving electrodes being formed on a top face of said laminate at positions corresponding to respective ones of said ink pressure chambers.

2. The inkjet head according to claim 1, wherein said laminate comprises a plurality of subunits, each subunit including a pair of said piezoelectric layers and one of said common electrodes interposed therebetween.

3. The inkjet head according to claim 1, wherein a total number of said piezoelectric layers is an even number and a total number of said common electrodes is an odd number, and wherein said piezoelectric layers and said common electrodes are laminated alternately with each other.

4. The inkjet head according to claim 1, wherein said piezoelectric unit includes a pair of said common electrodes interposed between said piezoelectric layers such that distances from a center of said piezoelectric unit to respective ones of said pair of common electrodes in the lamination direction are substantially the same.

5. The inkjet head according to claim 1, wherein each of said common electrodes has an exposed portion, said exposed portion being exposed on a side surface of said piezoelectric unit.

6. The inkjet head according to claim 5, wherein each of said common electrodes is grounded through said exposed portion.

7. The inkjet head according to claim 5, further comprising a conductive pattern formed on said side surface of said piezoelectric unit, said conductive pattern being electrically connected with each of said common electrodes at said exposed portion.

8. The inkjet head according to claim 7, wherein said piezoelectric unit is provided with a surface electrode formed on a peripheral area of said top face thereof, said conductive pattern extending up to said surface electrode to be electrically connected therewith.

9. The inkjet head according to claim 5, wherein said piezoelectric unit has a substantially trapezoidal planar form, and wherein said exposed portion of each of said common electrodes is exposed on an oblique side of said piezoelectric unit.

10. The inkjet head according to claim 1, wherein said plurality of driving electrodes are formed only on the top face of said laminate.

11. A piezoelectric actuator for an inkjet head, comprising:

a multilayer sheet including a plurality of piezoelectric layers and a plurality of common electrodes, each common electrode extending substantially over the whole area defined between adjacent piezoelectric layers sandwiching said common electrode, said plurality of piezoelectric layers and said plurality of common electrodes being arranged such that an upper half of said multilayer sheet and a lower half of said multilayer sheet are substantially mirror symmetric in a lamination direction; and a plurality of driving electrodes formed on an outer surface of said multilayer sheet.

12. The piezo electric actuator according to claim 11, wherein said multilayer sheet includes a plurality of sheet subunits, each sheet subunit including a pair of said piezoelectric layers and one of said common electrodes interposed therebetween.

13. The piezoelectric actuator according to claim 11, wherein a total number of said piezoelectric layers is an even number and a total number of said piezoelectric electrodes is an odd number, and wherein said piezoelectric layers and said common electrodes are laminated alternately with each other.

14. The piezoelectric actuator according to claim 11, wherein said multilayer sheet includes a pair of said common electrodes interposed between said piezoelectric layers such that distances from a center of said multilayer sheet to respective ones of said pair of common electrodes in the lamination direction are substantially the same.

15. The piezoelectric actuator according to claim 11, wherein each of said common electrodes has an exposed portion, said exposed portion being exposed on a side surface of said multilayer sheet.

16. The piezoelectric actuator according to claim 15, wherein each of said common electrodes is grounded through said exposed portion.

17. The piezoelectric actuator according to claim 15, further comprising a conductive pattern formed on said side surface of said multilayer sheet, said conductive pattern being electrically connected with each of said common electrodes at said exposed portion.

18. The piezoelectric actuator according to claim 17, wherein said multilayer sheet is provided with a surface electrode formed on a peripheral area of said top face a top face thereof, said conductive pattern extending up to said surface electrode to be electrically connected therewith.

19. The piezoelectric actuator according to claim 15, wherein said multilayer sheet has a substantially trapezoidal planar form, and wherein said exposed portion of each of said common electrodes is exposed on an oblique side of said multilayer sheet.

20. The piezoelectric actuator according to claim 11, wherein said plurality of driving electrodes are formed only on outer surface of said multilayer sheet.

21. An inkjet head, comprising:

a cavity unit having a plurality of ink pressure chambers formed at a regular interval; and a piezoelectric unit stacked on said cavity unit to close openings of said ink pressure chambers, said piezoelectric unit including a laminate and a plurality of driving electrodes, said laminate including a plurality of piezoelectric layers and a plurality of common electrodes, each common electrode extending over a plurality of ink pressure chambers, said plurality of piezoelectric layers and said plurality of common electrodes being arranged such that an upper half of said laminate and a lower half of said laminate are substantially mirror symmetric in a lamination direction, said plurality of driving electrodes being formed on a top face of said laminate at positions corresponding to respective ones of said pressure chambers.

* * * * *